United States Patent [19]

Ishibashi et al.

[11] 4,170,721

[45] Oct. 9, 1979

[54] MICROPHONE WITH MOLDED BLOCK AMPLIFIER ELECTROSTATIC

[75] Inventors: Hisanori Ishibashi, Tokyo; Tsuneso Tajima, Machida, both of Japan

[73] Assignee: Sony Corporation, Tokyo, Japan

[21] Appl. No.: 856,319

[22] Filed: Dec. 1, 1977

Related U.S. Application Data

[63] Continuation of Ser. No. 643,855, Dec. 23, 1975, abandoned.

[30] Foreign Application Priority Data

Dec. 27, 1974 [JP] Japan ..... 50-3688

[51] Int. Cl.[2] ..... H04R 19/04

[52] U.S. Cl. ..... 179/111 R

[58] Field of Search ..... 179/111 R, 111 E

[56] References Cited

U.S. PATENT DOCUMENTS

| | | | |
|---|---|---|---|
| Re. 28,420 | 5/1975 | Murphy | 179/111 E |
| 2,910,539 | 10/1959 | Hartsfield | 179/111 R |
| 3,300,585 | 1/1967 | Reedyk et al. | 179/111 R |
| 3,812,575 | 5/1974 | Hedman | 179/111 E |
| 3,816,671 | 6/1974 | Fraim et al. | 179/111 E |
| 3,864,531 | 2/1975 | Watson | 179/111 E |
| 3,946,422 | 3/1976 | Yagi et al. | 179/111 E |
| 4,014,091 | 3/1977 | Kodera et al. | 179/111 E |

FOREIGN PATENT DOCUMENTS

| | | | |
|---|---|---|---|
| 46-35035 | 10/1971 | Japan | 179/111 R |

OTHER PUBLICATIONS

*AWA Technical Review*, vol. 15, No. 2, Dec. 1973, pp. 53-64, R. E. Collins, "Application of Electrets to Electro-Acoustic Transducers".

*Bell Laboratories Record*, Aug. 1969, vol. 47, No. 7, pp. 245-248, "The Foil-Electret Microphone", G. M. Sessler et al.

*Primary Examiner*—George G. Stellar

*Attorney, Agent, or Firm*—Hill, Van Santen, Steadman, Chiara & Simpson

[57] ABSTRACT

A condenser microphone having an integrally molded unit with an active electronic element and a plurality of leads thereto encapsulated therein, and a backplate electrically coupled thereto via an axially adaptable connection providing improved manufacturing capabilities, and in which unidirectional and non-directional capabilities are incorporated without envelope modification.

3 Claims, 14 Drawing Figures

MICROPHONE WITH MOLDED BLOCK AMPLIFIER ELECTROSTATIC

This is a continuation of application Ser. No. 643,855, filed Dec. 23, 1975, now abandoned.

BACKGROUND OF THE INVENTION

1. Field of the Invention

This invention relates to a microphone and in particular to a novel condensor microphone providing unidirection and nondirectional capabilities.

2. Prior Art

Condensor microphones have a high output impedance and generally an active element such as a field effect transistor has been mounted in the microphone housing. Such microphones generally incorporate a diaphragm mounted in the housing, and a backplate assembly which consists of a backplate and a support for the backplate providing support therefor a predetermined distance from the diaphragm. The housing also encloses a printed circuit board on which is mounted an impedance converting means including an active element such as an FET and resistance elements. Output and power supply leads are supplied to the microphone and connected to the FET and the circuit board. Because of these complexities it was difficult to assemble such microphones when small in size, rendering such microphones expensive and subject to failure due to lead breakage.

The above problems have been solved by Ishibashi et al. as described in U.S. Pat. No. 3,775,572. There, an active element and necessary lead wires are molded in an insulating member, which supports a backplate thereon, one of the leads of the active element being connected to the backplate, whereby wiring and assembling are simplified. However, since active element and backplate are integrated in a body, if the conductive material used for the backplate is not coated on the insulating member uniformly, or if an upper surface of an insulating member is not formed flatly, the distance between the backplate and diaphragm is not uniform throughout. If such a reject backplate assembly is made, it cannot be used for a microphone even though the FET is good. This means that the FET is needlessly thrown away.

Further, there is a need for a microphone which can be switched for nondirectional to unidirectional reception and vice versa. Directional reception switching has been obtained by providing an additional acoustic chamber behind the diaphragm of the microphone. This has required high precision work and the microphone becomes bulky, making it unsuitable for incorporation in small size apparatus.

SUMMARY OF THE INVENTION

In accordance with the present invention, the backplate assembly is molded in an integral unit which is separate from the molded block carrying the FET element and is connected thereto by way of a slip or flexible connection permitting variations in housing dimensions but maintaining the diaphragm-to-backplate dimension. The molded parts provide, additionally, within the same general small confines as provided in the case of a nondirectional microphone, a switchable unidirectional capability.

It is, accordingly, an object of the invention to solve the above-mentioned problem of the microphone described in u.S. Pat. No. 3,775,572 by providing the molded block that encapsulates an active element as a separately prepared unit separably assembled to a backplate assembly. Thus, a defective backplate and insulating block assembly may be discarded without discarding the FET block assembly as well, or vice versa.

Another object of this invention is to provide a simple and very compact microphone having an unidirectional reception, keeping the benefits described above, where a molded block encapsulating the active element serves as a communication path to allow second sound waves to enter the microphone, directly (FIG. 1) or indirectly (FIG. 10).

Yet another object of this invention is the provision of a microphone in which an electrode of an active element encapsulated in a molded block is easily and completely separably connected to a backplate through a flexible connector in a manner retaining accurate relative positioning of the diaphragm and backplate.

Another object of this invention is to provide a microphone having efficient directionality while being of small size.

Still another object is to provide a microphone in which a backplate supporting insulating member is arranged of two members each having acoustic cavity portions so that an acoustic resistance may be inserted therebetween, providing good sensitivity in cooperation with sharply formed acoustic openings.

On the drawings

FIG. 1 is a vertical cross-sectional view of a condenser microphone of this invention;

FIGS. 2, 3 and 4 are perspective views of connectors which may be used in the condenser microphone shown in FIG. 1;

FIGS. 5 and 6 are partial sectional views of portions of a microphone;

FIGS. 7 and 9 are perspective views of molded blocks encapsulating an active element to be used for a microphone of this invention;

FIG. 8 is a sectional view taken along VIII—VIII of FIG. 7;

FIG. 10 is a vertical cross-sectional view of a second embodiment of a condenser microphone of this invention;

FIG. 11 is a perspective view of a molded block encapsulating an active element to be used for the microphone embodiment shown in FIG. 10;

FIG. 12 is a top plan view of an insulating member illustrated in FIG. 10;

FIG. 13 is a cross-sectional view taken along the line XIII—XIII of FIG. 12; and FIG. 14 is a bottom plan view of the insulating member illustrated in FIG. 12.

Figure 2:
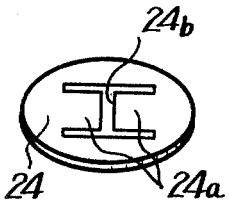

As generally required, the backplate 6 must be connected to an input terminal of the preamplifier, which, according to this embodiment, is done by connecting rear surface 6*b* of the backplate 6 with the electrode 15*a* through a connector 24, as shown in FIG. 2. The connector 24 there shown is of generally disc-shape of conductive material provided with an H-shaped window 24*b*, which is smaller than the width of electrode 15*a*, and with a pair of strip-like flexible conductors 24*a*. Since the backplate 6 has a recess 6*a* therein, the electrode 15*a* is inserted into the recess 6*a* through the window 24*b* deflecting strips 24*a*, so that backplate 6 is connected to the electrode 15*a* through the connector 24. In this case, since the conductors 24*a* have flexibility, the connection is easily and certainly performed. Further, there is a rubber insulating member 26 between the back of block 14 and the connector 24 to insulate block 14 and connector 24 and to serve as a shock absorber.

A shield plate 17 is disposed under the back 14, and also, a printed circuit board 18 is disposed under the shield plate 17. The board 18 is clamped by an end portion 1*c* of the housing 1, so that all the parts 4, 3, 5, 7, 9, 6, 14, 17 and 18 are enclosed in and clamped in the housing 1. The printed circuit board 18 is provided with a predetermined circuit, the electrodes 15*b* and 15*c* are extended through the board and then soldered. The board 18 also provides a ground terminal 16 which is connected to the housing 1 through a predetermined circuit pattern 16*a* formed on the board 18.

Figure 1:
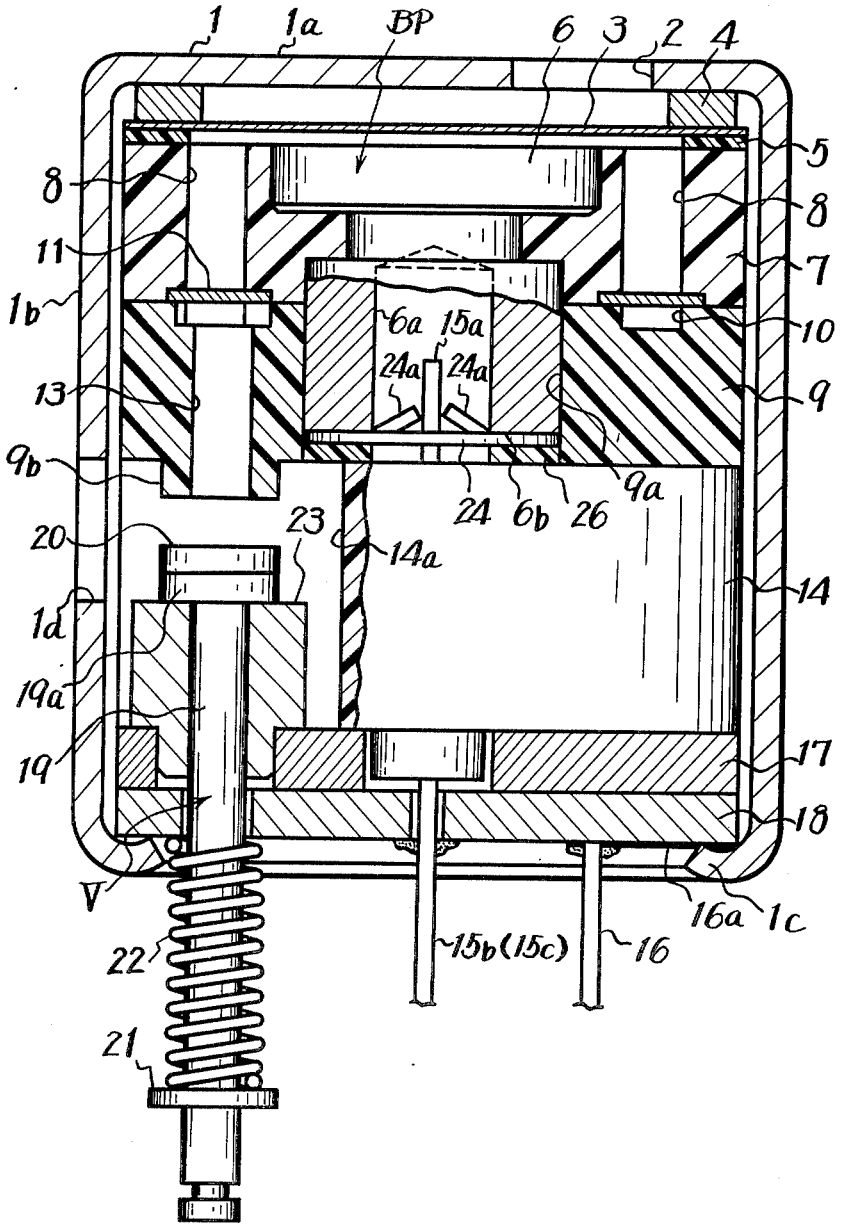
In FIG. 1 a cylindrically shaped shield housing 1, made of, for example, aluminum, has a plurality of openings 2 at its top surface 1*a* to allow first sound waves to enter the microphone. An electrical diaphragm 3 which has an electrically conductive ring 4 on its upper edge portion is disposed in the housing 1 and bears against the end of the housing 1. A backplate assembly BP consists of backplate 6 and first and second insulating members 7 and 9. The backplate 6, made of metal, is inserted into the first insulating member 7, made of plastic material, such that it is encapsulated during the molding process, and its upper surface is coplanar with the top surface of the first insulating member 7, so that their surfaces oppose the diaphragm 3. The first insulating member 7 is formed in generally cylindrical shape and has a plurality of openings 8, for example, six openings, to determine an acoustic chamber or cavity, which are arranged in a circle about its center. The second insulating member 9, also of plastic material, is formed in generally cylindrical shape and has an opening 13 to determine the air communication path which communicates with the openings 8 through an annular cavity 10 formed in the upper surface. There is an acoustic resistance 11, which is made of, for example, a fabric material, between the openings 8 and the cavity 10 to determine a predetermined acoustic resistance cooperation with cavities of openings 8 and 13 and cavity 10. Further, the second insulating member is provided with a central hole 9*a* to allow the insertion of a rear portion of the backplate 6. A generally annular shaped spacer 5 of insulating material is mounted between the diaphragm 3 and member 7 in the housing 1, as shown. A molded block 14 is provided under the backplate assembly BP, and is of generally cylindrical shape and of insulating material. An active element AE, shown in FIG. 8, which may be an FET or integrated circuit as used for a preamplifier and impedance convertor, and a plurality of leads 15*a*, 15*b* and 15*c* are encapsulated in block 14 during the molding process as disclosed in previously mentioned U.S. Pat. No. 3,775,572. The block 14 is provided with a cavity 14*a*, as shown in FIGS. 1, 7 or 9 to allow the insertion of a duct portion 9*b* of the second insulating member 9, so that the space 14*a* provides a communication path which communicates with not only the opening 13 but also the opening 1*d* formed in the housing 1. Further, when an FET is used for a preamplifier which is molded in the block 14, electrodes 15*a*, 15*b* and 15*c* are connected to gate, source and drain of FET, and the electrode 15*a* extends to the upper surface of the block 14 as input terminal and the remaining electrodes extend to bottom of the block 14, as output terminals.

The microphone may be switched from nondirectional to unidirectional reception and vice versa. In the embodiment shown in FIG. 1, the housing 1 is provided with additional opening 1*d* at its side surface 1*b* to allow second sound waves to enter the microphone, so that the opening 1*d* communicates with the opening 13. Therefore, if a communication path from the opening 1*d* to opening 13 is opened, the microphone is provided with a unidirectional reception, but if such path is closed, it is provided with nondirectional reception.

In this first embodiment, in order to close the communication path, the microphone is provided with a piston-like valve V which consists of a slide pin 19 having a disc plate 19*a*, rubber disc 20 and a spring 22 provided between a stopper 21 and the board 18. The pin 19 is slidably supported on a bearing member 23 which is mounted on the shield plate 17. The valve V is usually away from the opening 13 by a biasing of the spring 22. According to the microphone of this embodiment, the acoustic frequency characteristic is determined by mass of the diaphragm 3 and acoustic cavity of the openings 8, and the sensitivity against the sound waves depends upon the total cavity of the openings 8 and 13, so that if the total cavity is increased, sensitivity is increased at the low frequency range. Further, if the communication path between the openings 1*d* and 13 is closed by the rubber disc 20 of the valve V, the acoustic cavity is reduced, the microphone is switched to a non-directional reception, and the sensitivity at the low frequency range is reduced.

Figure 3:
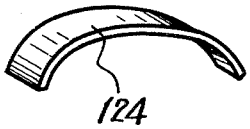
Figure 4:
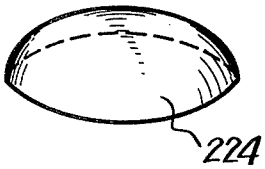
Figure 5:
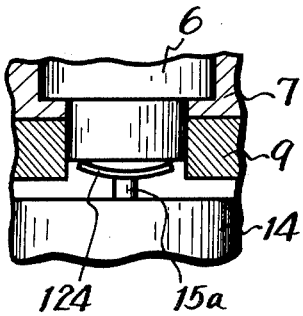
Figure 6:
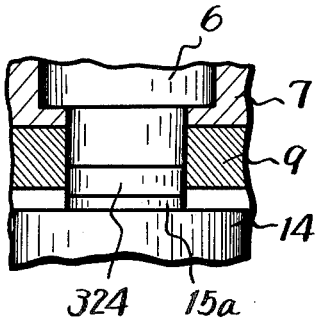
Figure 7:
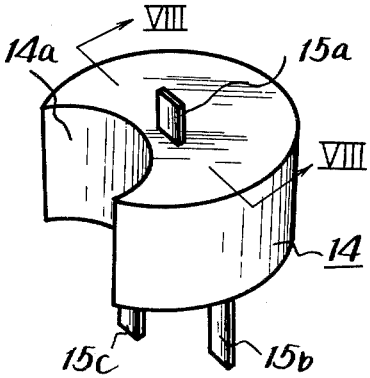
Figure 9:
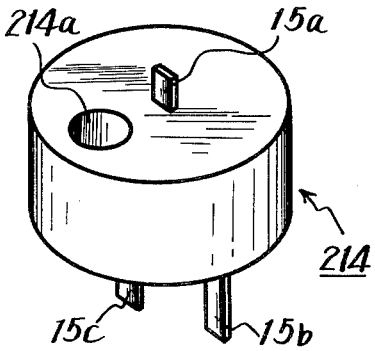
Figure 8:
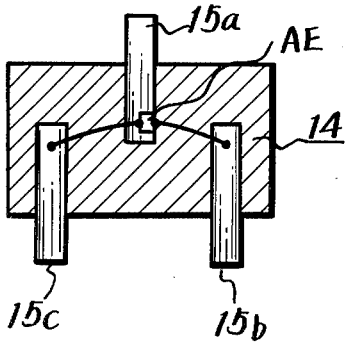

FIG. 3 shows a connector 124 having a flexibility, which may be used instead of the connector shown in FIG. 2. FIG. 4 shows a dome-like connector 224 which may be used instead of the connector shown in FIG. 2 or 3. If the connector 124 shown in FIG. 3 is used, the electrode 15*a* is cut short and is disposed between a backplate having no recess 6 and the electrode 15*a* as shown in FIG. 5. In this case, since the connector 124 has a spring action, the electrode 15*a* can be fit with backplate 6 through the connector 124. FIG. 6 shows another embodiment of a connector 324 which comprises a conductive rubber. FIG. 9 shows a molding block 214, which may be used instead of the block 14 shown in FIGS. 1 and 7. In this case, the block 214 is provided with an aperture 214*a* to be connected to a remote housing opening 1*d*, not shown.

Figure 11:
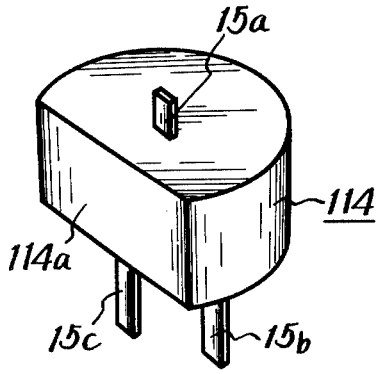
Figure 12:
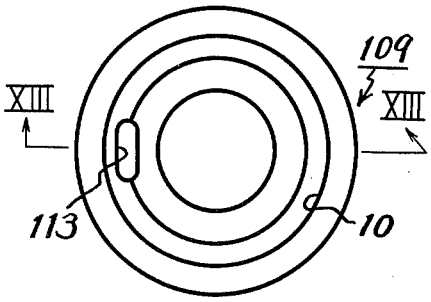
Figure 13:
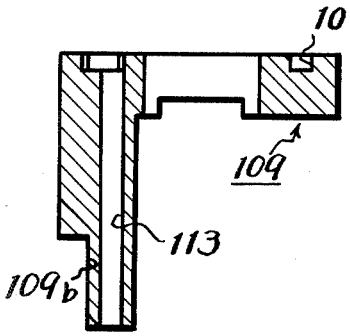
Figure 14:
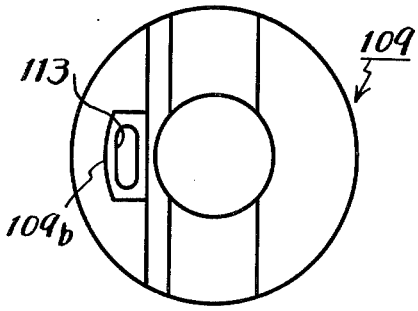
Figure 10:
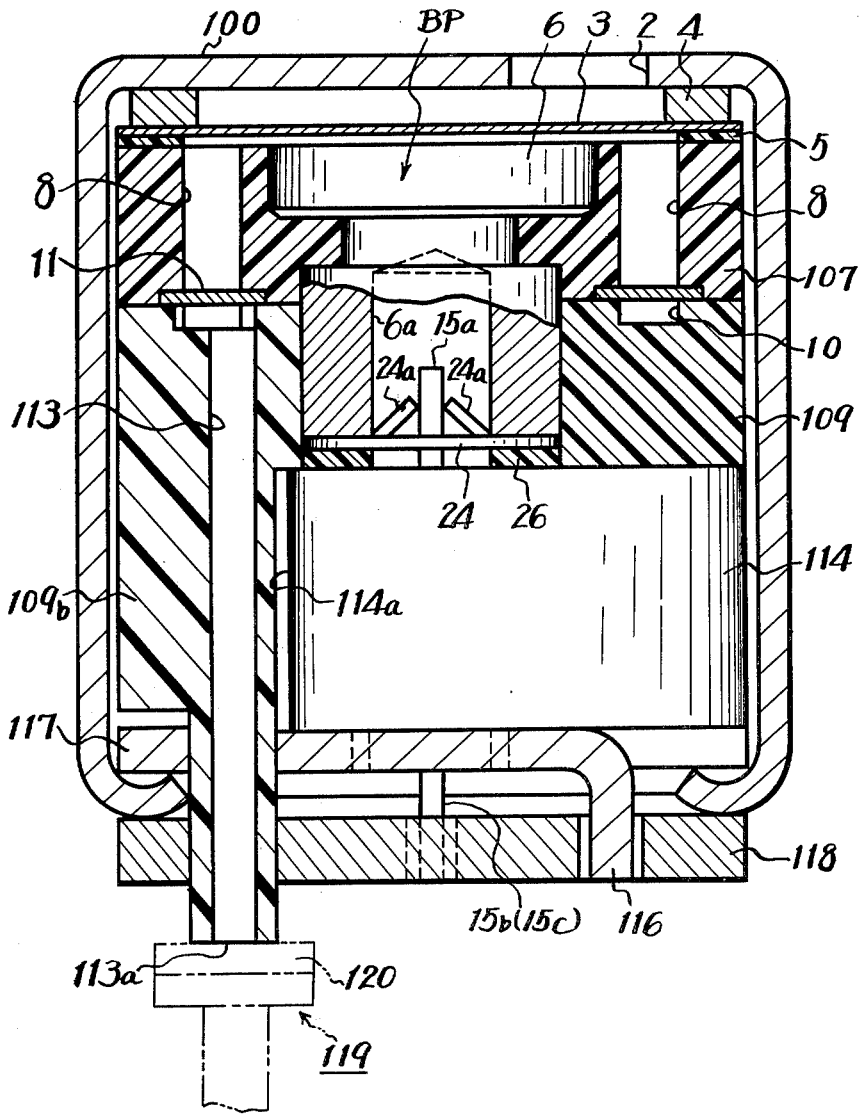

FIG. 10 shows a second embodiment of the microphone according to this invention. The microphone of FIG. 10 is constructed as well as the first embodiment, but the second insulating member 109 and molded block 114 are modified. As there shown, the molded block 114 is provided with a flat cut portion 114*a*, as shown in FIG. 11, to cooperate with an extending conduit or duct 109*b* of the second insulating member 109. As shown in FIGS. 10, 12, 13 and 14, the second insulating member 109 disposed between a first insulating member 107 and the block 114, has its integral extending portion 109*b* extending into the cut-away portion 114*a* of block 114, forming a communication path, and has an opening 113 which communicates with openings 8 through annular cavity 10. The downwardly extending portion or duct 109*b* extends to the outside of a housing 100 through the circuit board 118 so as to allow second sound waves to enter the microphone unless opening 113*a* is closed off by the selectively movable valve plunger 119 and rubber member 120. Further, a part of shield plate 117 serves for a ground terminal 116 which extends through the board 118.

It will be seen from the above description that an extremely simple, compact, and easily assembled microphone has been provided. Prior production problems have been solved with a substantial saving in reject costs and, at the same time simplicity and electrical soundness have been maintained. Further, directionality control has been incorporated within the same envelope in a simple manner not contemplated in prior systems. It will be apparent that still further variations may be made beyond those shown, without departing from the novel concepts of our invention. It is, accordingly, our intention that the scope of our invention be limited solely by that of the hereinafter appended claims.

We claim as our invention:

1. A condenser microphone comprising:

a housing having an opening;

diaphragm means facing said opening;

a backplate assembly consisting of a backplate and insulating means for supporting said backplate in position under and adjacent said diaphragm means and having at least one acoustic cavity;

separate molded block means for encapsulating an active element having electrodes and separably positioned in said housing under the backplate assembly; a recess in said backplate assembly; and mechanically deflectable connection means positioned in said recess and comprising slidingly telescoping conductive elements separably connecting one of said electrodes to said backplate with a residual resilient spring bias transversely urging said conductive elements into electrical contact.

2. A condenser microphone comprising:

a housing having an opening;

diaphragm means facing said opening;

a backplate assembly consisting of a backplate and insulating means for supporting said backplate in position under and adjacent said diaphragm means and having at least one acoustic cavity;

separate molded block means for encapsulating an active element having electrodes and separably positioned under the backplate assembly; and mechanically deflectable connection means separably connecting one of said electrodes to said backplate with a residual resilient spring bias maintaining said connection;

wherein said molded block is relieved to provide a communication path therethrough to said cavity; and wherein said block provides a cut portion to form said communication path, and further includes valve means in said cut portion for selectively opening or closing said path.

3. A condenser microphone comprising:

a housing having an opening;

diaphragm means facing said opening;

a backplate assembly consisting of a backplate and insulating means for supporting said backplate in position under and adjacent said diaphragm means and having at least one acoustic cavity;

separate molded block means for encapsulating an active element having electrodes and separably positioned under the backplate assembly; and mechanically deflectable connection means separably connecting one of said electrodes to said backplate with a residual resilient spring bias maintaining said connection;

wherein said molded block is relieved to provide a communication path therethrough to said cavity; and wherein said relieved portion of said block faces an opening in said housing facing in a direction laterally of the said opening.

* * * * *